US008990976B1

(12) United States Patent
Saccone et al.

(10) Patent No.: US 8,990,976 B1
(45) Date of Patent: Mar. 31, 2015

(54) PORTABLE VEHICLE AND MULTI-APPLICATION ASSISTANCE SEAT

(71) Applicants: Rick M. Saccone, Akron, OH (US); Jeffrey E. Wilhite, Akron, OH (US)

(72) Inventors: Rick M. Saccone, Akron, OH (US); Jeffrey E. Wilhite, Akron, OH (US)

( * ) Notice: Subject to any disclaimer, the term of this patent is extended or adjusted under 35 U.S.C. 154(b) by 0 days.

(21) Appl. No.: 13/675,672

(22) Filed: Nov. 13, 2012

Related U.S. Application Data

(60) Provisional application No. 61/558,770, filed on Nov. 11, 2011.

(51) Int. Cl.
*A61G 3/02* (2006.01)
*A61G 3/06* (2006.01)

(52) U.S. Cl.
CPC .... *A61G 3/02* (2013.01); *A61G 3/06* (2013.01)
USPC ..... 5/81.1 HS; 5/81.1 R; 296/65.01

(58) Field of Classification Search
CPC ..... A61G 7/06; A61G 7/0281; A61G 7/1025
USPC ..... 5/81.1 R, 81.1 HS, 94; 414/921; 297/232, 344.18; 296/65.01, 65.11; 108/44, 116, 127, 130–132, 160; 4/560.1
See application file for complete search history.

(56) References Cited

U.S. PATENT DOCUMENTS 2,919,658 A * 1/1960 Kakoska ..... 104/94
3,410,232 A * 11/1968 Bills et al. ..... 108/146
3,469,880 A * 9/1969 Woodward ..... 296/65.01
3,709,159 A * 1/1973 Oglesby, Jr. ..... 108/44
4,494,465 A * 1/1985 Fick, Jr. ..... 108/44
5,009,170 A * 4/1991 Spehar ..... 108/36
5,435,614 A * 7/1995 Nordberg ..... 296/64
5,769,005 A * 6/1998 Haynes ..... 108/116
6,129,403 A * 10/2000 Townsend ..... 296/65.01
6,173,660 B1 * 1/2001 Emmert ..... 108/90
6,256,806 B1 * 7/2001 DiTommaso ..... 4/560.1

(Continued)

FOREIGN PATENT DOCUMENTS

GB 2071585 A * 9/1981 ..... B60N 1/00

OTHER PUBLICATIONS

AbleData Car Transfer Aid, "Driver Side Transfer Seat by Veigel (Model 4500)" web page, Oct. 9, 2014, 1 page, http://www.abledata.com/abledata.cfm?pageid=19327&top=13902&ksectionid=19327&productid=205960&trail=0&discontinued=0.

(Continued)

*Primary Examiner* — Michael Trettel
(74) *Attorney, Agent, or Firm* — Brennan, Manna & Diamond, LLC

(57) ABSTRACT

An uneven surface assistance device is disclosed including a first leg assembly and a second leg assembly having a length different. The assemblies are connected directly or indirectly to a supporting platform and are movable with respect to the supporting platform between a first lockable position orthogonal to the supporting platform and a stored position parallel to the supporting platform. The device further includes a transverse support connected to the supporting platform generally in between the first leg assembly and the second leg assembly. The support connects to a first arm connected to the first leg assembly where the first arm is parallel to the supporting platform when the first leg is in the stored position and the support further connects to a second arm connected to the second leg assembly where the second arm is parallel to the supporting platform when the second leg is in the stored position.

20 Claims, 4 Drawing Sheets

(56) References Cited

U.S. PATENT DOCUMENTS

| | | | | |
|---|---|---|---|---|
| 6,283,528 | B1 * | 9/2001 | Townsend | 296/65.01 |
| 2012/0013102 | A1 * | 1/2012 | Gao | 280/304.1 |

OTHER PUBLICATIONS

AbleData Car Transfer Aid, "Easy-Transfer" web page, Oct. 9, 2014, 1 page, http://www.abledata.com/abledata.cfm?pageid=113583&top=0&productid=125986&trail=0.

Spinal Cord Injury Network, "Wheelchair to Car Transfer Block: A Shoulder-less Effort" web page, Oct. 16, 2014, 2 pages, http://www.spinalnetwork.org.au/sci-perspectives/wheelchair-to-car-transfer-block-a-shoulder-less-effort.

Washington Safe Patient Handling, "Transfer Assist Devices for the Safer Handling of Patients" web page, Oct. 21, 2013, 22 pages, http://www.washingtonsafepatienthandling.org/images/transfer_assist_devices.pdf.

DuraMed Medical Services, "Transfer Board" web page, Oct. 17, 2014, 3 pages, http://www.duramedmedical.com/Drive-Transfer-Board-detail.htm?productId=17461507&ez=Drive+Transfer+Board~q=ssaaTransfer+Boardzzbidaa406zz~r=~&source=searchbar.

Drive Medical, "Bath Benches/Stools" web page, Oct. 17, 2014, 2 pages, http://www.drivemedical.com/index.php/bath-safety/bath-benches-stools.html?p=2.

Drive Medical, "Transfer Benches" web page, Oct. 17, 2014, 2 pages, http://www.drivemedical.com/index.php/bath-safety/transfer-benches.html.

Vancare, "Assistive Devices" web page, Oct. 17, 2014, 3 pages, http://www.vancare.com/index.php/products/assistive-devices.

Stander, "Automobile" web page, Oct. 17, 2014, 2 pages, http://www.stander.com/products/automobile.

* cited by examiner

PORTABLE VEHICLE AND MULTI-APPLICATION ASSISTANCE SEAT

This application claims the benefit of U.S. Provisional Application Ser. No. 61/558,770 filed Nov. 11, 2011.

A portable, vehicle assist seat may assist individuals and healthcare providers to safely transition persons with ambulatory issues into and out of a vehicle. The seat may fit on or over the door sill of a vehicle to secure the seat in a receiving position allowing a person to enter or exit either a vehicle from either the passenger side or driver side and either front or back seat. As more completely described below, the seat may include a staggered set of telescoping legs with a short set to adjust to the seat and sill height in the vehicle and a longer set to adjust to the grade level outside of the vehicle. The seat can act as a bridge allowing the passenger to safely transfer from a wheel chair, walker, cane, crutches, or other ambulatory devices by sitting on the seat outside of the vehicle and then slide on to the internal seat at the same level avoiding strain or injury entering the vehicle. Desirably, the weight of the passenger is safely born by the seat and therefore injuries may be avoided, such as hyper-extending the lower back, shoulders, arms, elbows or legs. In addition, the seat may help prevent injury to the caregiver or other person(s) assisting the passenger into the vehicle. The device can be used for transition into a bathtub, as a handyman table on stair steps and other such purposes. While other uses on other uneven surfaces will become apparent, the disclosure and drawings will primarily focus on the exemplary use as a vehicle assistance device.

DESCRIPTION OF DRAWINGS

The accompanying drawings, which are incorporated in and constitute a part of the specification, illustrate various example systems, methods and so on, that illustrate various example embodiments of aspects of the invention. It will be appreciated that the illustrated element boundaries (e.g., boxes, groups of boxes, or other shapes) in the figures represent one example of the boundaries. One of ordinary skill in the art will appreciate that one element may be designed as multiple elements or that multiple elements may be designed as one element. An element shown as an internal component of another element may be implemented as an external component and vice versa. Elements may not be drawn to scale and in some instances, cross-hatching is not shown to improve clarity.

DETAILED DESCRIPTION

Figure 1:
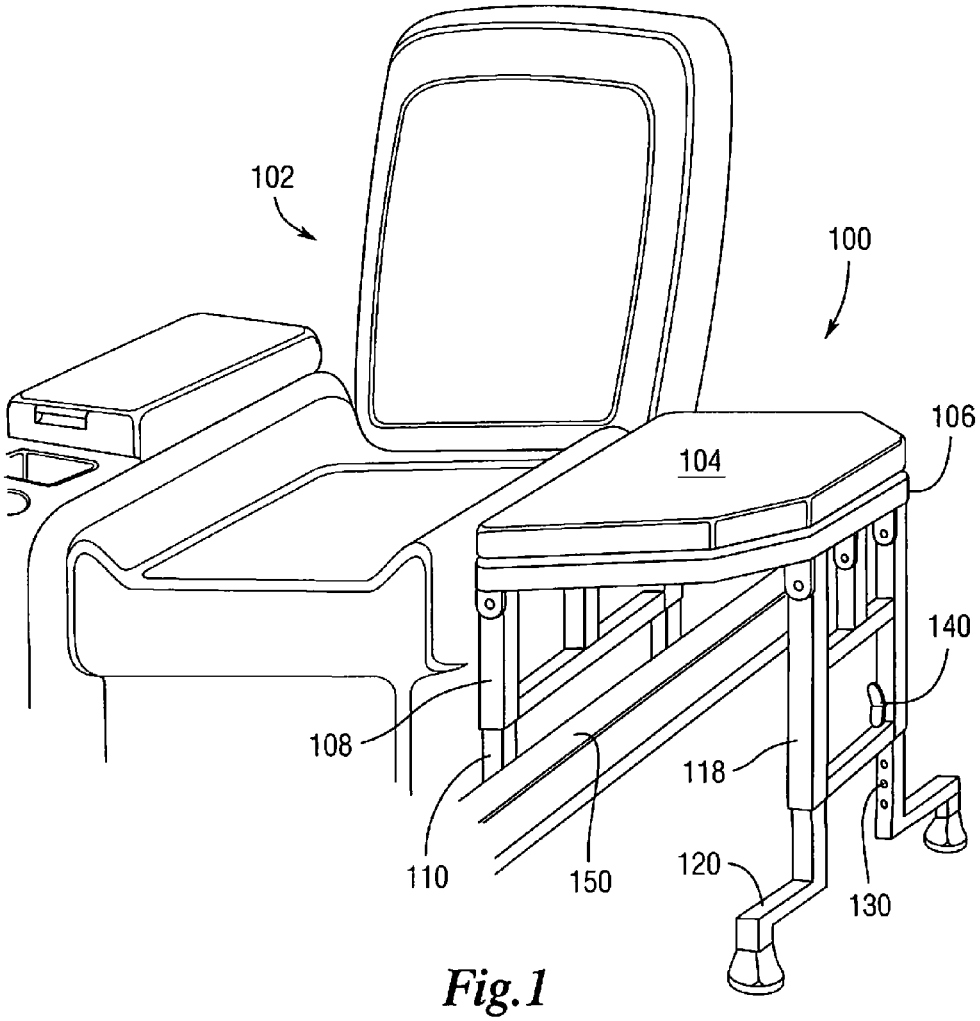
FIG. 1 is a perspective view of an assist device adjacent to a vehicle seat.

With reference now to FIG. 1, an assistance device 100 is shown in condition for use adjacent to a vehicle seat 102. In use, the assistance device 100 includes a generally level platform or surface 104 supported on a frame 106. On one side 105 (FIG. 2) first legs 108 connect to the frame 106 in an angularly movable, but lockable relation. First feet 110, may in turn adjustably extend from the first legs 108. On a generally opposed side 115 (FIG. 2), second legs 118, generally about two to three times longer than the first legs 108, may connect to frame 106 in a similarly angularly movable, but lockable relation. Second feet 120 may adjustably extend from the second legs 118. Each adjustable foot 110, 120 may include a series of predefined holes or detents 130 for cooperation with a locking pin 140 connected to each leg 108, 118. Generally, shorter legs will have a length between about 6 to 12 inches, preferably about 8 inches. The longer legs will have a length between about 12 to 24 inches, preferably about 16 inches. These dimensions in connection with the additional variability in height derived from the further extendable feet have been found to accommodate all passenger motor vehicles tested.

Figure 2:
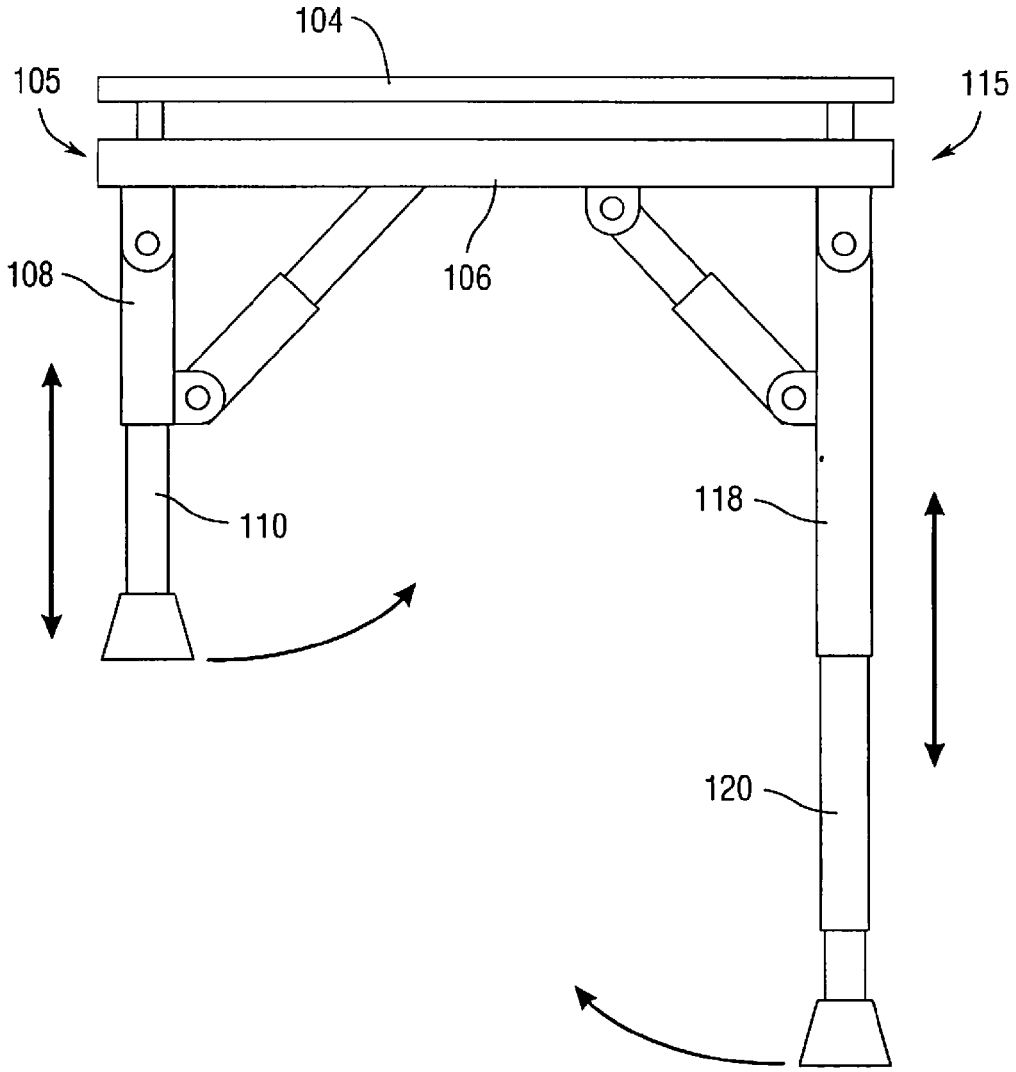
FIG. 2 is a side view of an assist device.

With reference now to FIGS. 1 and 2, in use, the device 100 may assist a user entering or exiting (either deemed "egressing" herein) a vehicle such as by placing the first feet 110 temporarily on a sill plate 150 or between the sill plate 150 and the vehicle seat 102 within a doorway of a vehicle. The second legs 118 and feet 120 may be arranged to be temporarily supported and disposed on the ground. Ideally, the device is adjusted so that the surface 104 and frame 106 is maintained in an essentially level orientation. Once the user has successfully egressed the vehicle, the device 100 may be retrieved, the feet 110, 120 optionally retracted, the legs 108, 118 folded into a stored position, and the device stowed for later use.

Figure 3:
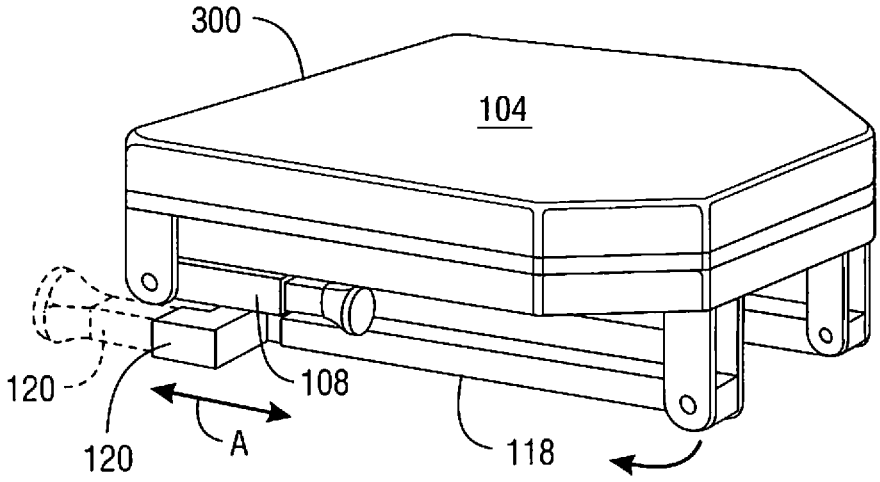
FIG. 3 is a top, side perspective view of an assist device in a stored configuration.
Figure 4:
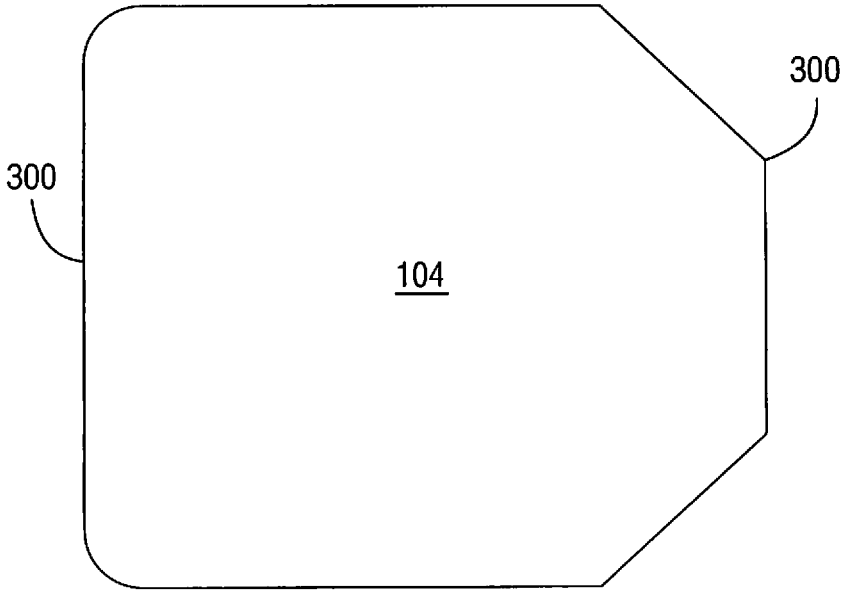
FIG. 4 is a top plan view of an assist device in a stored configuration.

Referring now to FIGS. 3 and 4, when in the stored configuration feet 110, 120 and legs 108 and 118 preferably collapse into a parallel configuration with the frame 106 and are contained within a periphery 300 of the frame 106 or the supporting platform 104. Alternately, the feet 110, 120 may be left in an extended position along an axis A to enhance speed of use over storing in the most compact form.

Figure 5:
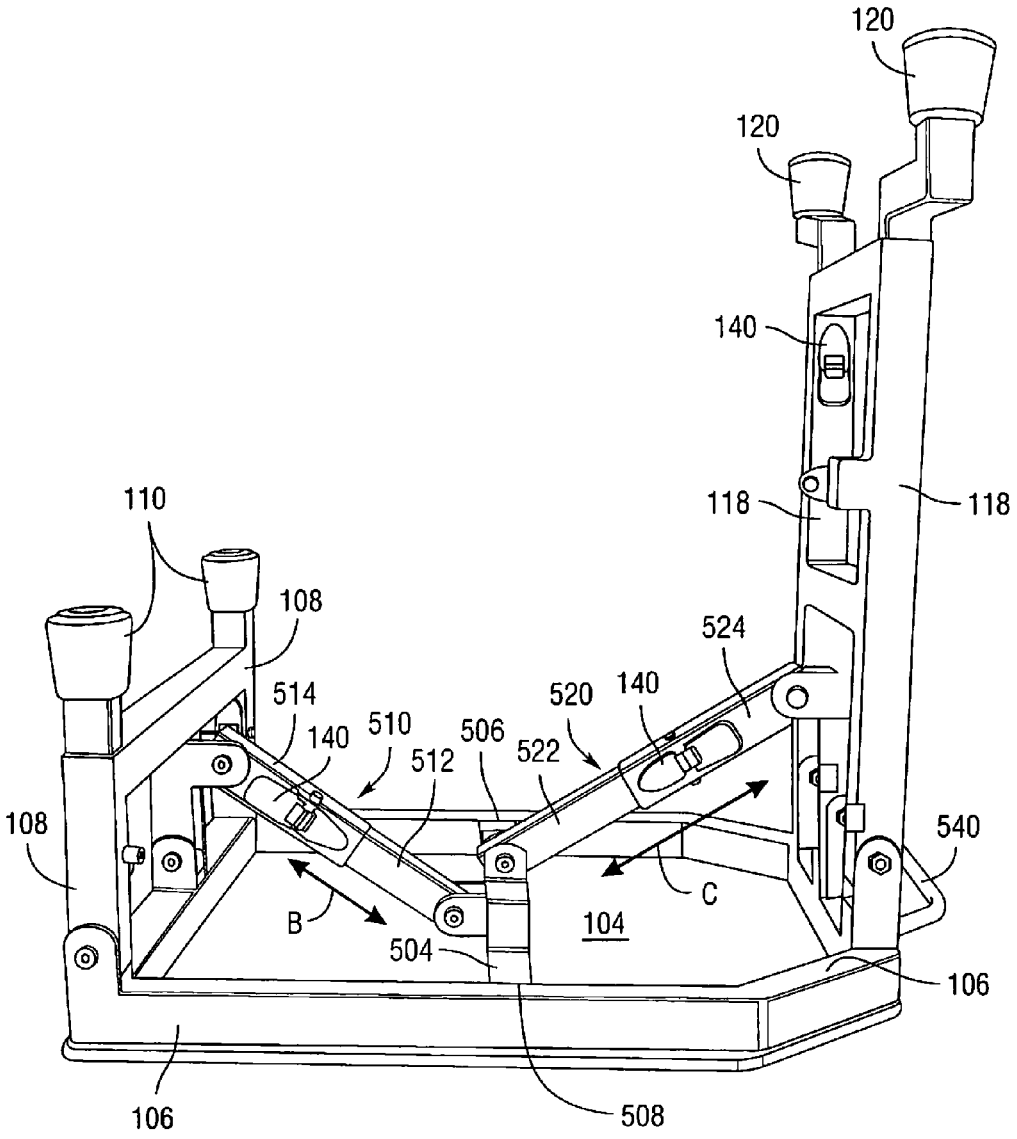
FIG. 5 is a perspective view of the underside of an assist device.

Referring now to FIG. 5, a frame 106 may include a transverse support bar 504 attached to roughly opposing portions 506, 508 along the frame 106 periphery for further support of the platform 104 and to provide a connection for locking arms 510, 520. In an embodiment, locking arm 510 includes a first element 512 that telescopes within a second element 514 as indicated by arrow B. In the position illustrated, locking pin 140 on the second element 514, operably engages a receiving hole (not shown, 130 in FIG. 1) in the first element. When the locking pin is disengaged, locking arm 510 may collapse its two elements, and allow leg 108 to come to a stored position parallel to the frame 106. Optionally, a separate receiving hole in the first element will permit the locking pin 140 to lock the leg 108 in the stored position. Similarly, locking arm 520 includes first element 522 configured to telescope with second element 524 as indicated by arrow C. The arm elements may be locked into relative position, for example, extended as illustrated or stored, by locking pin 140 cooperating with a recess or hole in the first element 522. An assist seat may also include a handle 540 formed on the frame 106 or cut through a portion of the platform 104 to allow a user to grip the device around the frame.

While the systems, methods, and so on have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on provided herein. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicants' general inventive concept. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

As used herein, "connection" or "connected" means both directly, that is, without other intervening elements or components, and indirectly, that is, with another component or components arranged between the items identified or described as being connected. To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the claims (e.g., A or B) it is intended to mean "A or B or both". When the applicants intend to indicate "only A or B but not both" then the term "only A or B but not both" will be employed. Similarly, when the applicants intend to indicate "one and only one" of A, B, or C, the applicants will employ the phrase "one and only one". Thus, use of the term "or" herein is the inclusive, and not the exclusive use. See, Bryan A. Garner, A Dictionary of Modern Legal Usage 624 (2d. Ed. 1995).

The invention claimed is:

1. A manufacture comprising:

A frame supporting a platform, the frame defining an outer peripheral edge and a transverse support connecting two points of the frame;

A first leg assembly pivotably connected to the frame, the first leg assembly pivotable between a first position normal to the frame and a second position parallel to the frame; and A second leg assembly having a length greater than the first leg assembly, the second leg assembly being pivotably connected to the frame between a first position normal to the frame and a second position parallel to the frame;

Where the transverse support includes a first arm connected to the first leg assembly where the first arm comprises a pair of telescoping elements adjustably fixed by a locking pin and receiving hole and adjusts from a retracted position parallel to the frame to an extended locking position at an angle relative to the frame.

2. The manufacture as set forth in claim 1, where the transverse support includes a second arm connected to the second leg assembly where the second arm adjusts from a retracted position parallel to the frame to an extended locking position at an angle relative to the frame.

3. The manufacture as set forth in claim 1, where the first leg assembly comprises a foot telescoping from and lockingly connected to the first leg assembly, and the foot is disposed inside an automobile cabin and the second leg assembly is disposed external to the automobile cabin such that the frame is maintained in an essentially level orientation.

4. The manufacture as set forth in claim 1, where the second leg assembly comprises a telescoping foot, a locking pin and receiving hole.

5. The manufacture as set forth in claim 1, where the first leg assembly comprises two independently adjustable feet.

6. The manufacture as set forth in claim 5, where the independently adjustable feet extend along an axis of the leg assembly to one of a plurality of predefined lengths.

7. The manufacture as set forth in claim 1, where the second leg assembly comprises two independently adjustable feet.

8. An uneven surface assistance device comprising:

A frame supporting a platform, the frame defining an outer peripheral edge and a transverse support connecting two points of the frame;

A first leg assembly pivotably connected to the frame, the first leg assembly pivotable between a first position normal to the frame and a second position parallel to the frame; and A second leg assembly pivotably connected to the frame, the second leg assembly including a telescoping foot adjusted by a locking pin and receiving hole arrangement where the second leg assembly is operable to permit pivotable movement between a first position normal to the frame and a second position parallel to the frame;

Where the transverse support includes a first arm connected to the first leg assembly where the first arm adjusts between a retracted position parallel to the frame and an extended position at an angle relative to the frame, and the transverse support includes a second arm connected to the second leg assembly where the second arm adjusts between a retracted position parallel to the frame and an extended position at an angle relative to the frame.

9. The uneven surface assistance device as set forth in claim 8, where the first leg assembly comprises a foot telescoping from and lockingly connected to the first leg assembly by a locking pin and receiving hole arrangement.

10. The uneven surface assistance device as set forth in claim 8, where the first arm comprises a pair of telescoping elements adjustably fixed by cooperation between a locking pin and receiving hole.

11. The uneven surface assistance device as set forth in claim 8, where the first leg assembly comprises a foot telescoping from and lockingly connected to the first leg assembly, and the foot is disposed inside an automobile cabin and the second leg assembly is disposed external to the automobile cabin such that the frame is maintained in an essentially level orientation.

12. The uneven surface assistance device as set forth in claim 8, where the platform supported by the frame is capable of supporting the weight of a user.

13. The uneven surface assistance device as set forth in claim 8, where an acute angle is defined between the first arm when connected to the first leg assembly in the first position and the platform.

14. In combination:

A motor vehicle having a sill plate within a doorframe; and

An uneven surface assistance device comprising:

A frame supporting a platform, the frame including a periphery and a transverse support connecting two points of the periphery;

A first leg assembly pivotably connected to the frame, the first leg assembly pivotable between a first position normal to the frame and a second position parallel to the frame, the first leg assembly including at least one first adjustably extendable foot, where the at least one first foot is held within the motor vehicle by the sill plate; and A second leg assembly having a length greater than the first leg assembly, the second leg assembly being pivotably connected to the frame between a first position normal to the frame and a second position parallel to the frame, the second leg assembly including at least one second foot adjustably extendable foot, where the at least one second foot contacts ground on which the motor vehicle rests such that the frame is maintained in an essentially level orientation.

15. The combination as set forth in claim 14, where the transverse support includes a first arm connected to the first leg assembly where the first arm adjusts from a retracted position parallel to the frame and a locking extended position at an angle relative to the frame.

16. The combination as set forth in claim 14, where the transverse support includes a second arm connected to the second leg assembly where the second arm adjusts from a retracted position parallel to the frame and a locking extended position at an angle relative to the frame.

17. The combination as set forth in claim 14, where the transverse support includes a first arm connected to the first leg assembly where the first arm comprises a set of telescoping elements fixable by a locking pin operably engaging a receiving hole.

18. The combination as set forth in claim 14, where the transverse support includes a second arm connected to the second leg assembly where the second arm comprises a set of telescoping elements fixable by a locking pin operably engaging a receiving hole.

19. The combination as set forth in claim 14, where the at least one first adjustably extendable foot lockingly connects with the first leg assembly by a locking pin and receiving hole arrangement.

20. The combination as set forth in claim 14, where the at least one second adjustably extendable foot lockingly connects with the second leg assembly by a locking pin and receiving hole arrangement.

* * * * *